US006079448A

United States Patent [19]

Lee

[11] Patent Number: 6,079,448

[45] Date of Patent: Jun. 27, 2000

[54] FAUCET ASSEMBLY OF A WATER TREATMENT SYSTEM

[76] Inventor: Shih-Ping Lee, 6F, No. 200-2, Pei-Tun Rd, Taichung City, Taiwan

[21] Appl. No.: 09/273,355

[22] Filed: Mar. 22, 1999

[51] Int. Cl.[7] ..... E03C 1/04

[52] U.S. Cl. ..... 137/801; 137/359; 251/104; 251/110; 251/353; 251/354

[58] Field of Search ..... 137/359, 801; 251/104, 110, 353, 354

[56] References Cited

U.S. PATENT DOCUMENTS

Re. 15,225 11/1921 Jarvis ..... 251/110
25,853 10/1859 Stickney ..... 251/353

*Primary Examiner*—Gerald A. Michalsky

*Attorney, Agent, or Firm*—Rosenberg, Klein & Lee

[57] ABSTRACT

A faucet assembly includes a body connected to an outlet member on the top thereof and a water pipe connected to the underside thereof, a valve member movably received in the body and operatably connected to the outlet member so that when pushing the outlet member, the valve member is lowered to open the communication between the body and the outlet member. The body has a ridge extending radially outward from the outside thereof and a hook member connected to the outlet member so that when the outlet member is pushed, the hook member is engaged with the ridge to keep the valve member in position so that the water flows out from the outlet member. The hook member is disengaged from the ridge by shifting a bar connected to the hook member so that the valve member closes the body again.

6 Claims, 11 Drawing Sheets

FAUCET ASSEMBLY OF A WATER TREATMENT SYSTEM

FIELD OF THE INVENTION

The present invention relates to a faucet assembly, and more particularly, to a control device in the faucet of a water treatment system for conveniently control the faucet.

BACKGROUND OF THE INVENTION

Referring to FIG. 11, a conventional faucet 90 of a water treatment system (not shown) generally includes a body 91 with a lever 910 rotatably connected to the body 91 which extends through the upper board 12 of the kitchen sink 11 and is engaged with the pipe 13 under the board 12 of the kitchen sink 11. A tubular outlet 94 extends from the body 91 so that when operating the lever 910, water from the water treatment system flows out from the tubular outlet 94. However, the engagement between the body 91 and the board 12 is not secure enough so that it tends to loose or shake because the threaded extension 910 of the body 91 is positioned by only a collar 911 on the board 12 and a nut 92 mounted to the threaded extension 910.

The present invention intends to provide a faucet assembly for a water treatment system wherein the faucet assembly is securely connected to the board of the kitchen board and has a control device for easily operating the faucet assembly.

The present invention provides a faucet assembly which is operated by pressing a top cap thereof to allow the water to flow from the outlet thereof and stop the flowing of the water by shifting a bar on the top cap.

SUMMARY OF THE INVENTION

In accordance with one aspect of the present invention, there is provided a faucet assembly comprising a lower member connected to the water pipe and having an insertion extending from the top thereof wherein the insertion has a passage communicating with the water pipe. A body has a connecting tube extending from the top thereof which has an inner tube extending downwardly therefrom, the two tubes communicating with each other via a hole defined through the top. The inner tube is mounted to the insertion. The connecting tube has a ridge extending radially outward therefrom and a valve member is biasedly received in the inner tube and normally closes the hole.

An outlet member has a section movably inserted into the connecting tube and communicates with the connecting tube. The section of the outlet member contacts the valve member. A flange extends radially from the outlet member and a top cap mounted thereto. The flange has a slot defined therethrough and the top cap has an aperture. A spring is urged between the flange and the top of the body.

A release mechanism has a rod which has an end plate on the first end and a hook formed on the second end thereof. The end plate is movably engaged with the aperture and has a bar extending therefrom. The rod extends through the aperture and the slot with the hook disengagably engaged with the ridge.

The object of the present invention is to provide a faucet assembly which is operated by longitudinally pressing the top cap thereof.

Another object of the present invention is to provide a faucet assembly wherein the body of the assembly is not applied a lateral force during the operation of the faucet assembly.

Further features of the present invention will become apparent after a careful reading of the detailed description with appropriate reference to the accompanying drawings.

DETAILED DESCRIPTION OF THE PREFERRED EMBODIMENTS

Figure 1:
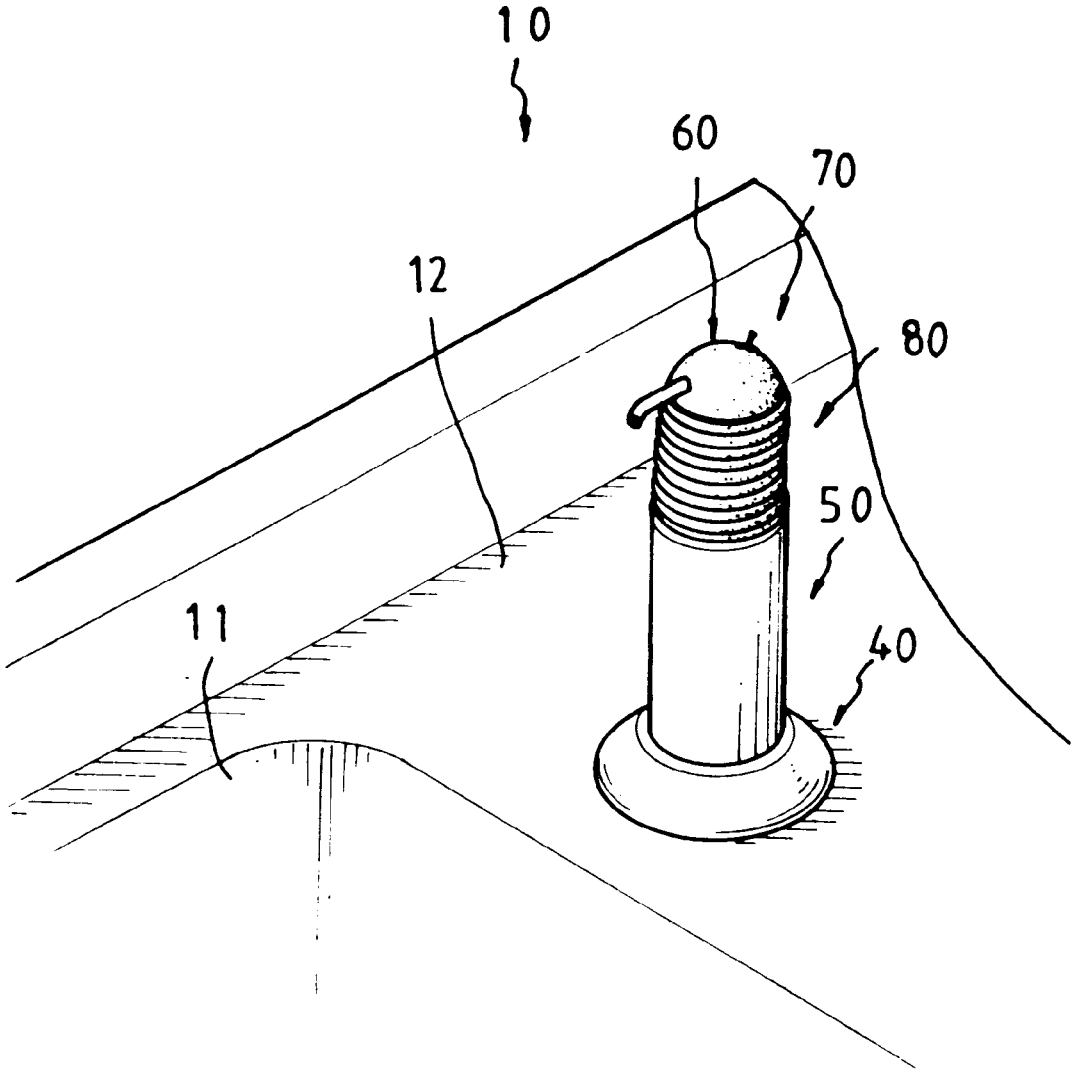
FIG. 1 is a perspective view of faucet assembly in accordance with the present invention.
Figure 2:
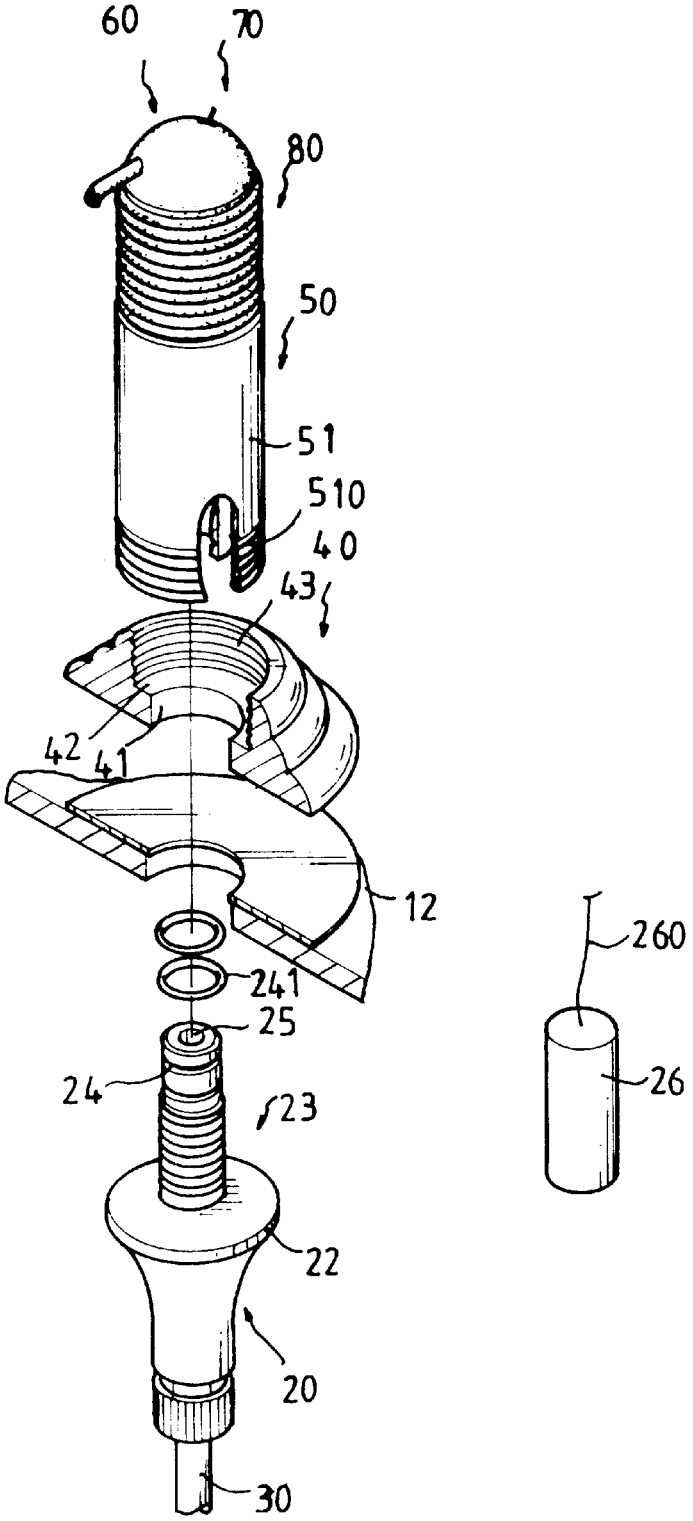
FIG. 2 is an exploded view of the parts for securely connecting the body of the faucet assembly in accordance with the present invention to the board of the kitchen sink.

Referring to FIGS. 1, 2, 3, 5 and 6, the faucet assembly in accordance with the present invention comprises a lower member 20 which has a large top surface so as to contact against the underside of the board 12 of the kitchen sink 11, and connects to the water pipe 30 to the lower end thereof by a nut 21. An insertion 23 extends from the top thereof and has a passage 25 communicating with the water pipe 30. The insertion 23 has two grooves 24 defined in the outside thereof so as to receive the seals 241 therein.

A body 50 (see FIG. 5) has a top with a connecting tube 56 extending therefrom and an inner tube 52 extending from the underside of the top, a hole 520 defined through the top to communicate the connecting tube 56 and the inner tube 52. The connecting tube 56 has an annular flange 560 extending radially inward from the inside thereof and a ridge 562 extending radially outward therefrom. A skirt portion 51 extends from the periphery of the top of the body 50 so that an annular magnet 54 is mounted to the inner tube 52 and received between the skirt portion 51 and the inner tube 52 into which a filter member 55 is received. The insertion 23 of the lower member 20 is received in the inner tube 52. A valve member 81 is biasedly received in the inner tube 52 and normally closes the hole 520 which has a tapered inner periphery. The valve member 81 has a disk 811 with a seal 810 mounted thereto and a valve rod 812 extends from the disk 811. A collar member 813 is fixedly mounted to the valve rod 812 and a spring 83 is biased between the annular flange 560 of the connecting tube 56 and the collar member 813 so as to keep the disk 811 to close the hole 520. The valve rod 812 contacts the section 610 of the outlet member 61.

An outlet member 61 has a horizontal section to which an outlet tube 63 is connected and a vertical section 610 which is movably inserted into the connecting tube 56 and communicates with the connecting tube 56. The vertical section 610 has grooves 611 defined in the outside thereof so as to receive two seals 612 therein, and the vertical section 610 is cooperated with a clamp 561 to ensure that the vertical section 610 will not be disengaged from the connecting tube 56. The vertical section 610 of the outlet member 61 contacts the valve rod 812 of the valve member 81. A flange 62 extends radially from the outlet member 61 and a top cap 60 is mounted thereto, and a spring 84 is urged between the flange 62 and the top of the body 50. An outer tube 85 is mounted between the flange 62 of the outlet member 61 and the top of the body 50 to prevent dust from entering the space between the body 50 and the outlet member 61. The flange 62 has a slot 620 defined therethrough and the top cap 60 has an aperture 601 defined therethrough.

A release mechanism 70 has a rod 711 which has an end plate 71 on the first end and a hook 712 formed on the second end thereof. The end plate 71 is movably engaged with the aperture 601 and biased by a resilient member 72, and has a bar 710 extending therefrom. The rod 711 extends through the aperture 601 and the slot 620, and the hook 712 is disengagably engaged with the ridge 562.

Figure 4:
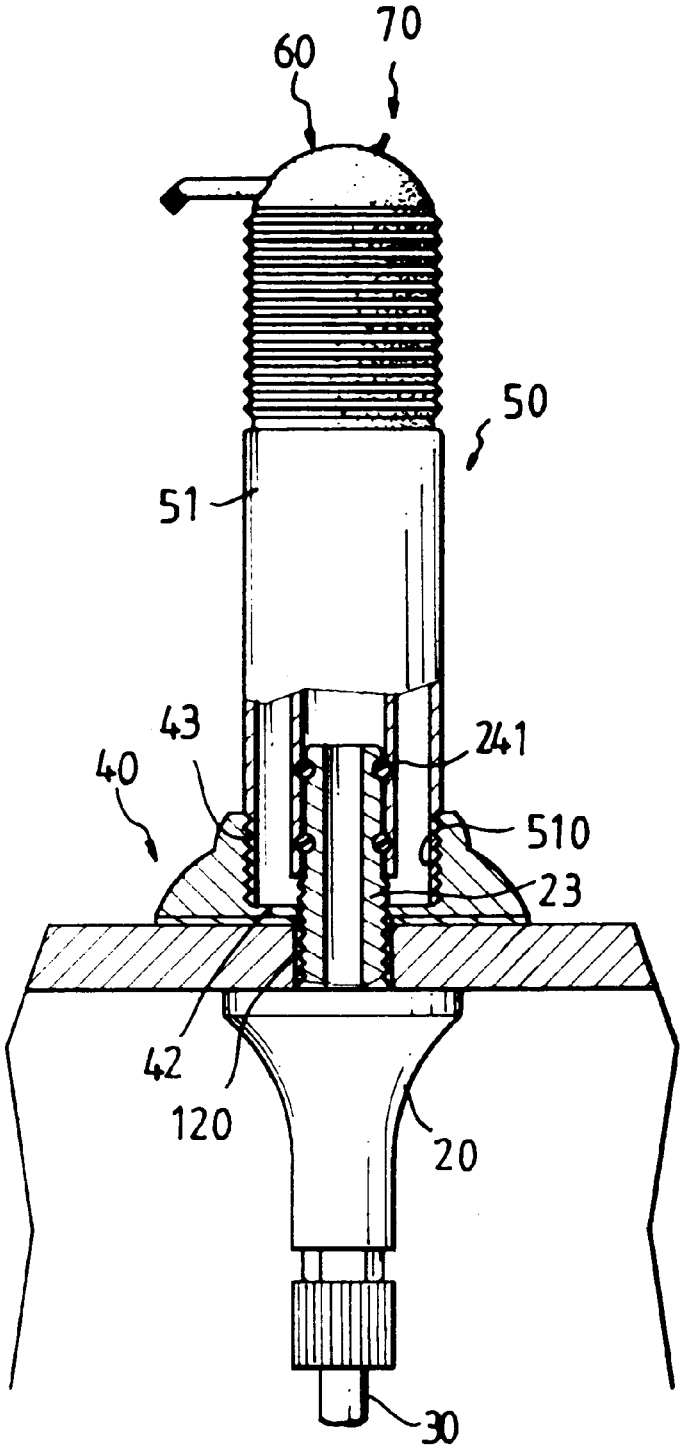
FIG. 4 is a side elevational view, partly in section, of the faucet assembly in accordance with the present invention, wherein the board of the kitchen sink is thicker than that shown in FIG. 3.
Figure 5:
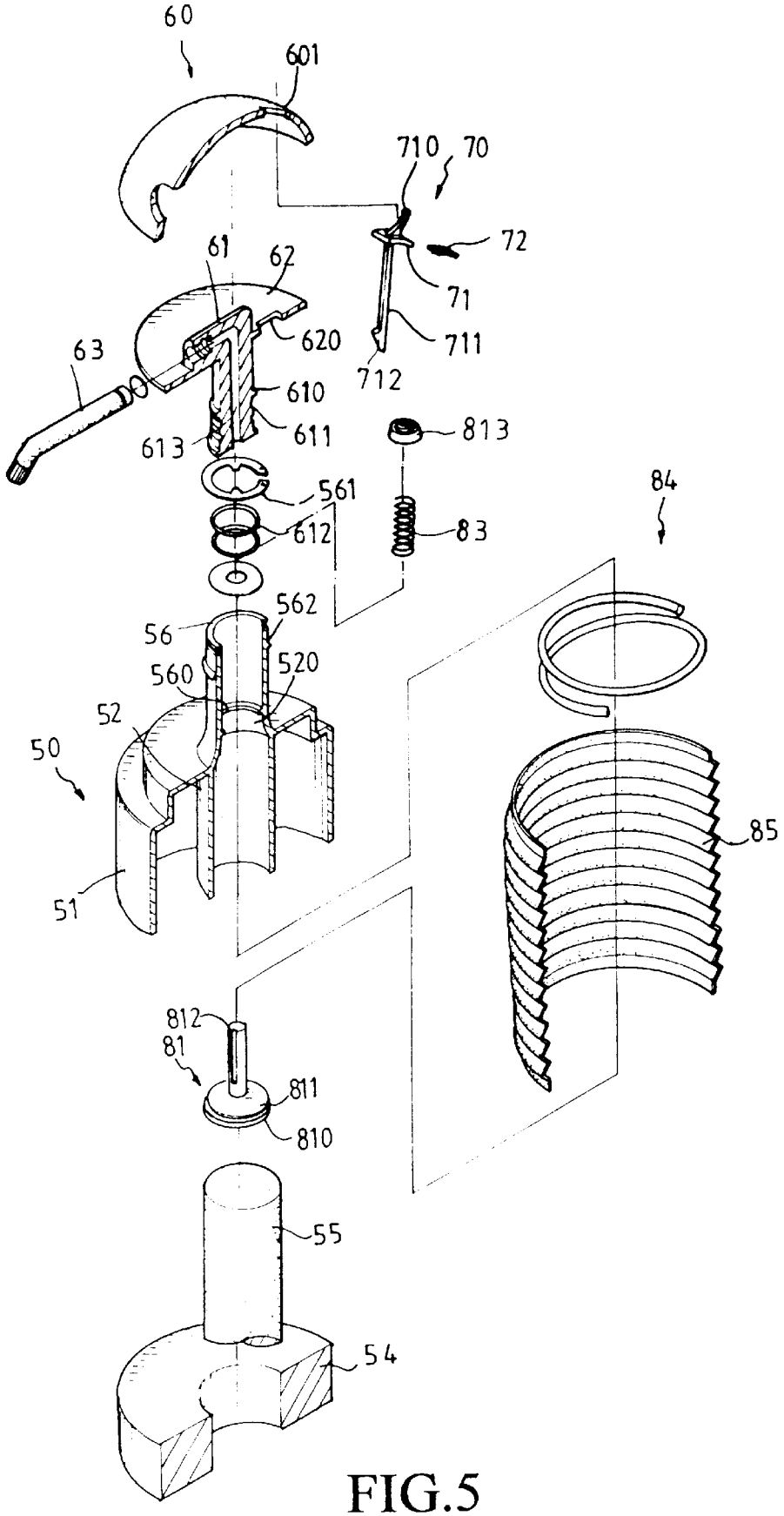
FIG. 5 is an exploded view of the faucet assembly in accordance with the present invention.
Figure 6:
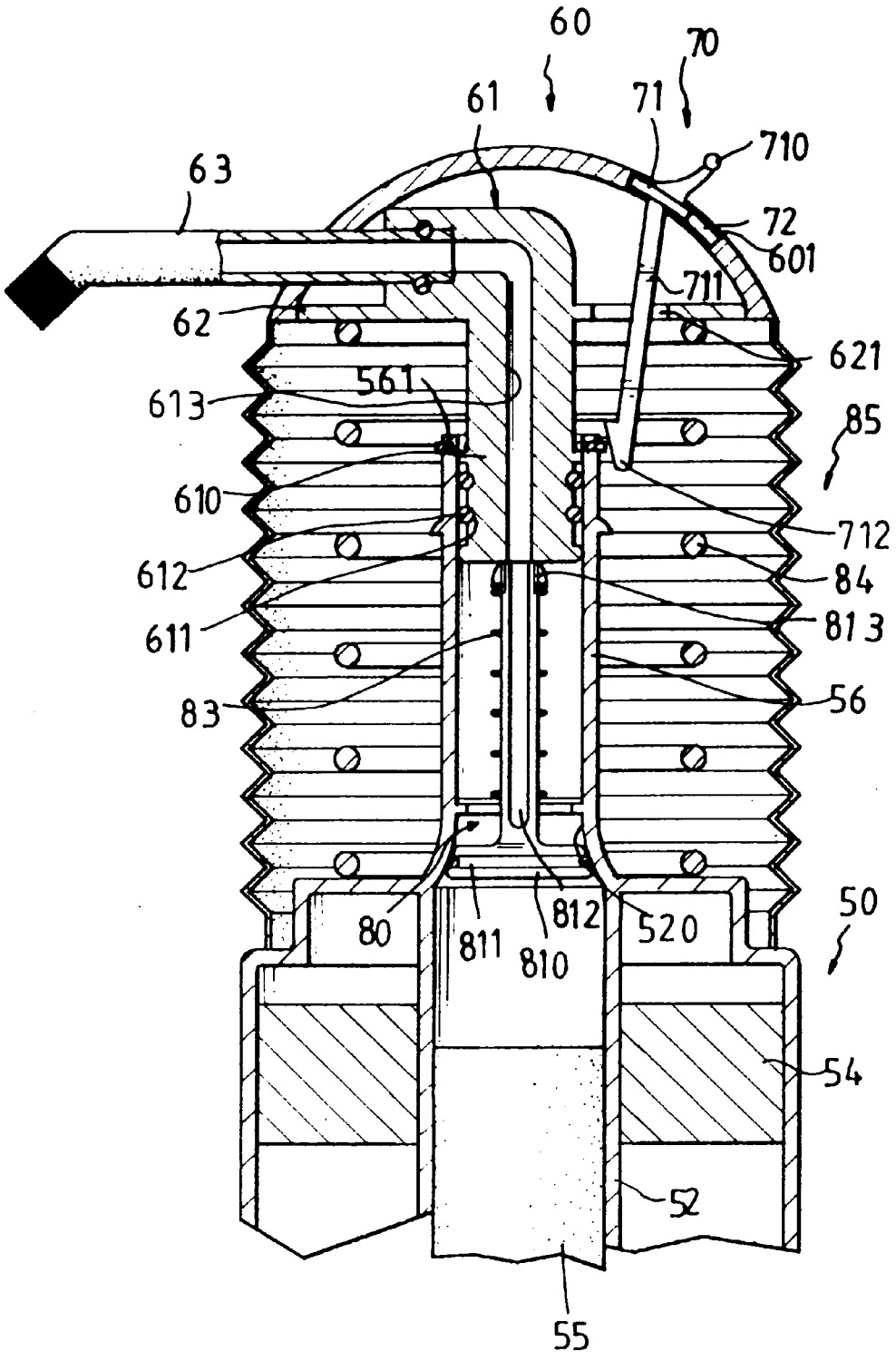
FIG. 6 is a side elevational view, partly in section, of the faucet assembly in accordance with the present invention, wherein the top cap is not yet pressed.

A base member 40 with a central hole 41 has a tapered shape and has an inner threaded portion 43. A flange 42 extends radially inward from the periphery of the central hole 41 so as to support the lower end of the skirt portion 51. The skirt portion 51 has an outer threaded portion 510 defined in the lower end thereof so as to engage with the inner threaded portion 43 such that the contacting areas between the board 12 of the kitchen sink 11 and the base member 40 and the lower member 20 are large enough to securely position the faucet assembly of the present invention. Of course, when the board 12 of the kitchen sink 11 is thicker as shown in FIG. 4, the thickness of the flange 42 can be reduced so that the section of the insertion 23 extending beyond the board 12 and the flange 42 is still long enough to connect the inner tube 52.

Figure 7:
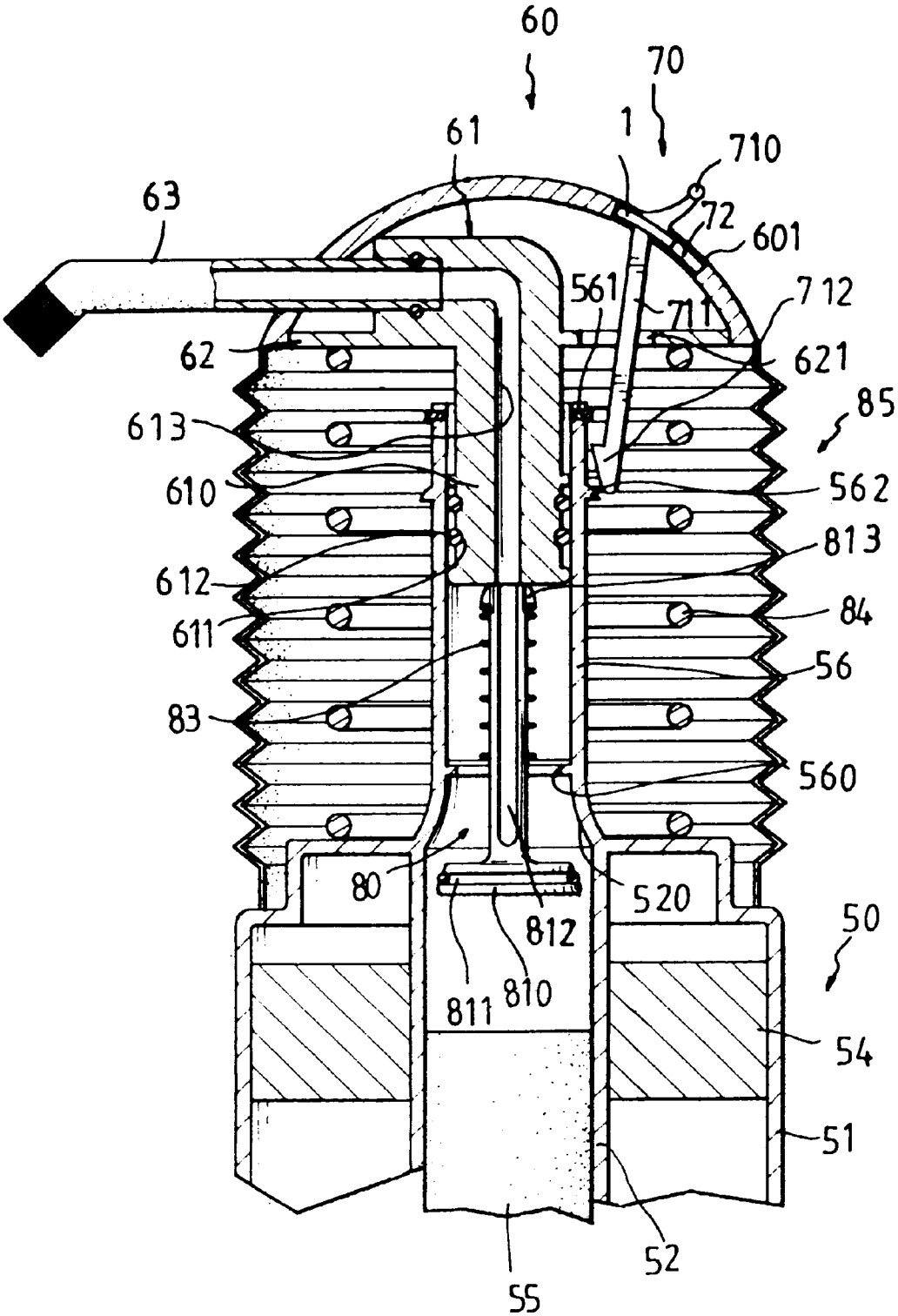
FIG. 7 is a side elevational view, partly in section, of the faucet assembly in accordance with the present invention, wherein the top cap is pressed.
Figure 8:
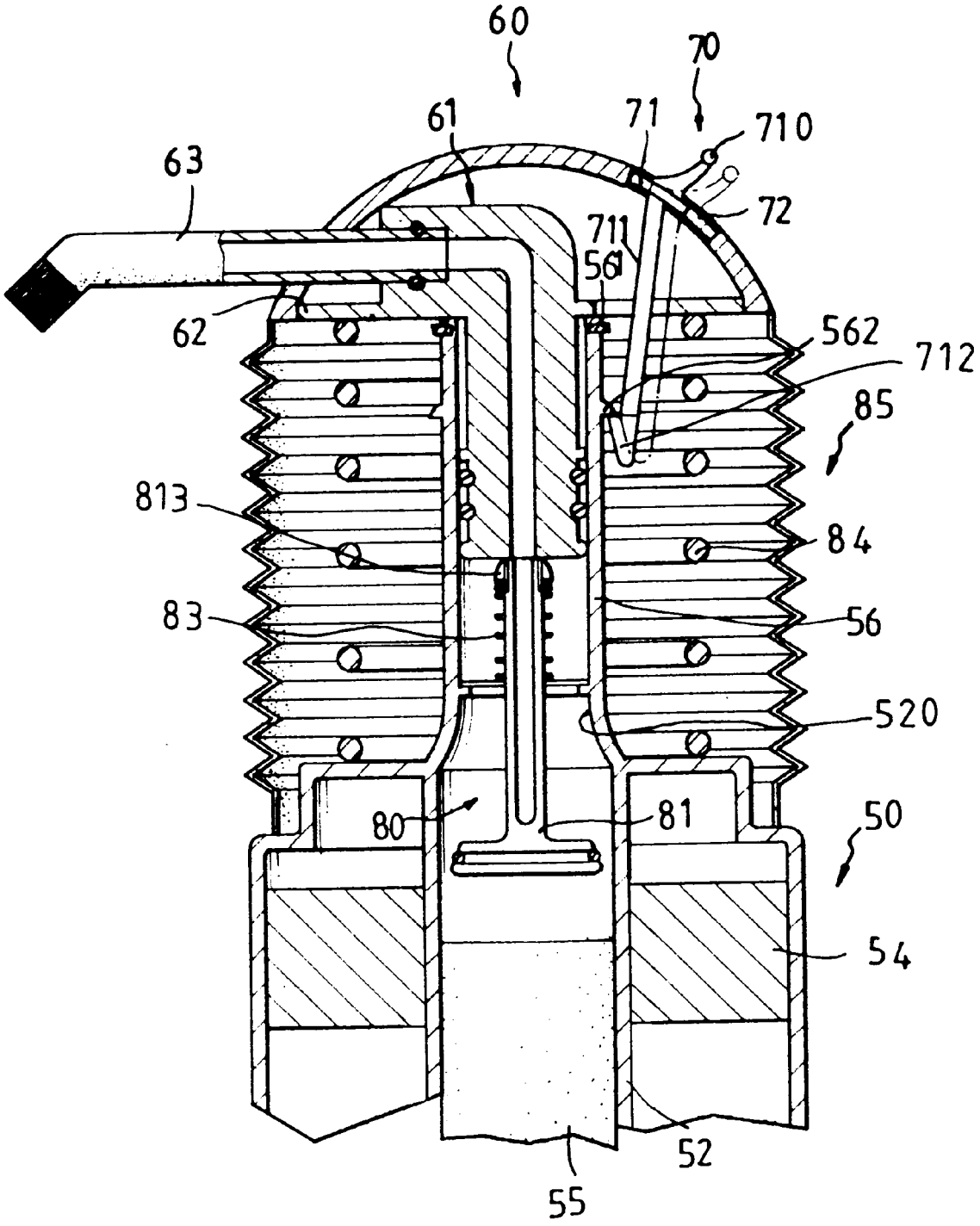
FIG. 8 is a side elevational view, partly in section, of the faucet assembly in accordance with the present invention, wherein the top cap is completely pressed and the hook is engaged with the ridge of the connecting tube to position the valve member.

FIGS. 7 and 8 show that when pressing the top cap 60, the outlet member 61 together with the hook 712 are lowered till the hook 712 is engaged with the ridge 562, the valve member 81 is lowered by the movement of the outlet member 61 so that water flows form the outlet tube 63 even if the hand is removed from the top cap 60. When shifting the bar 710, the hook 712 is removed from the ridge 562 and the outlet member 61 and the valve member 81 return to their original positions by the springs 84 and 83 to close the hole 520 of the top of the body 50.

Figure 3:
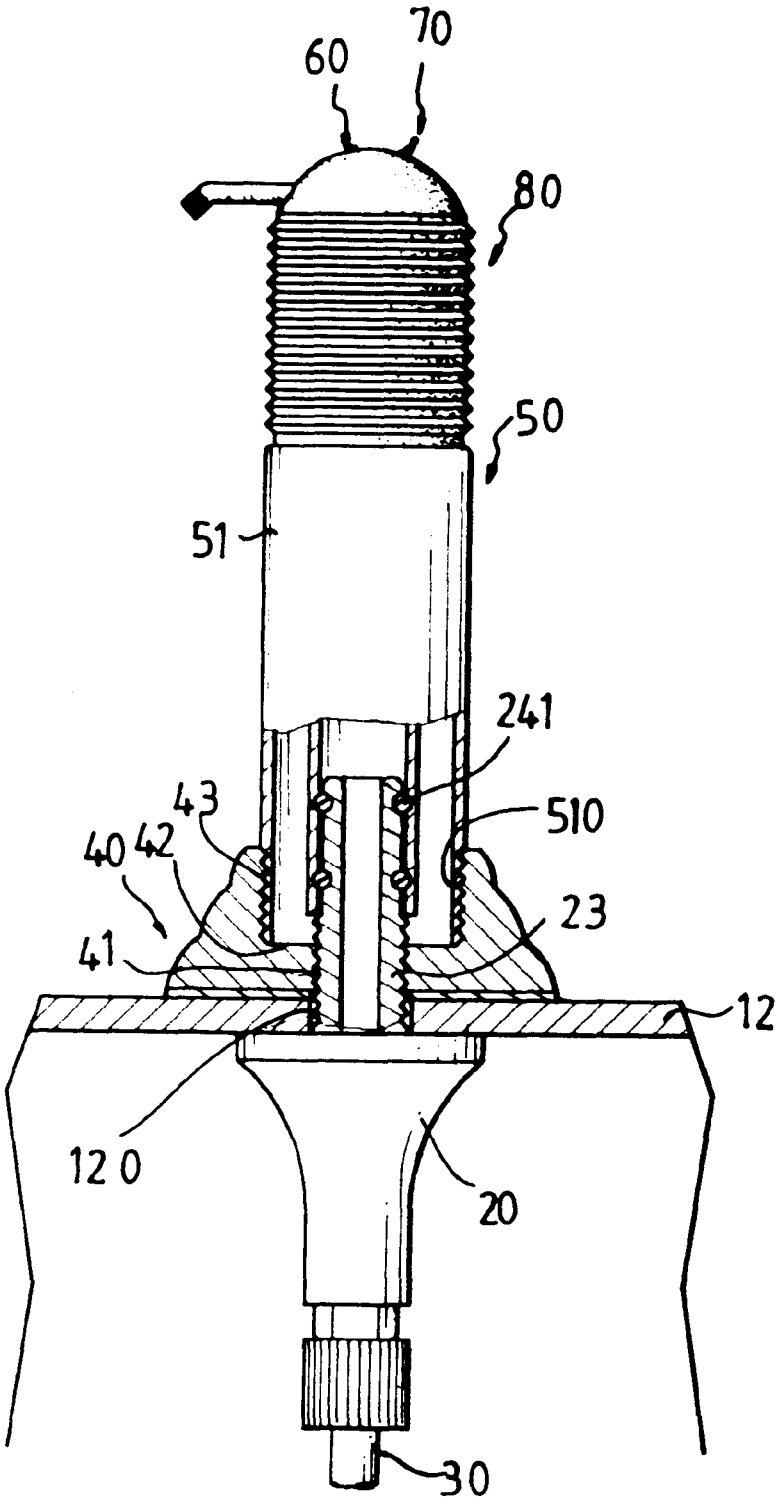
FIG. 3 is a side elevational view, partly in section, of the faucet assembly in accordance with the present invention.
Figure 9:
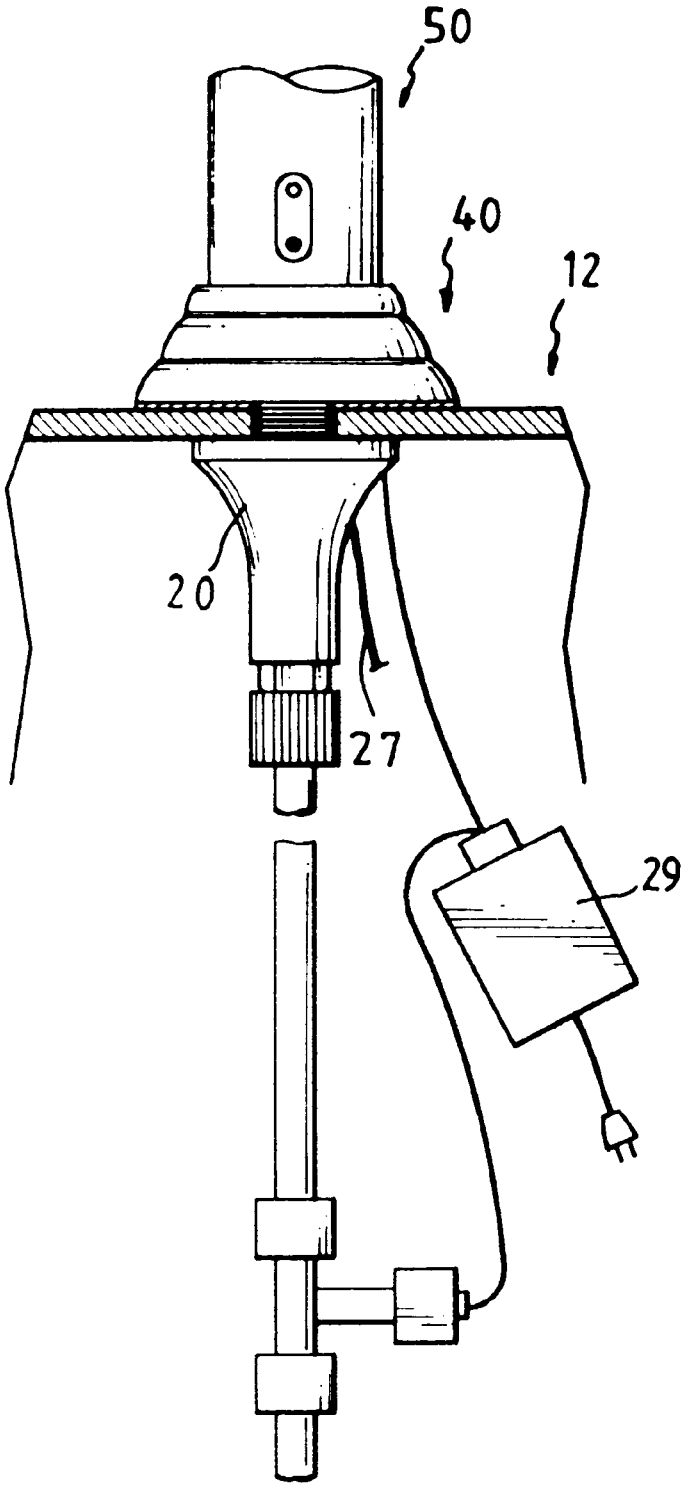
FIG. 9 is an illustrative view to show an air tube and a detection means are connected to the faucet assembly of the present invention.
Figure 10:
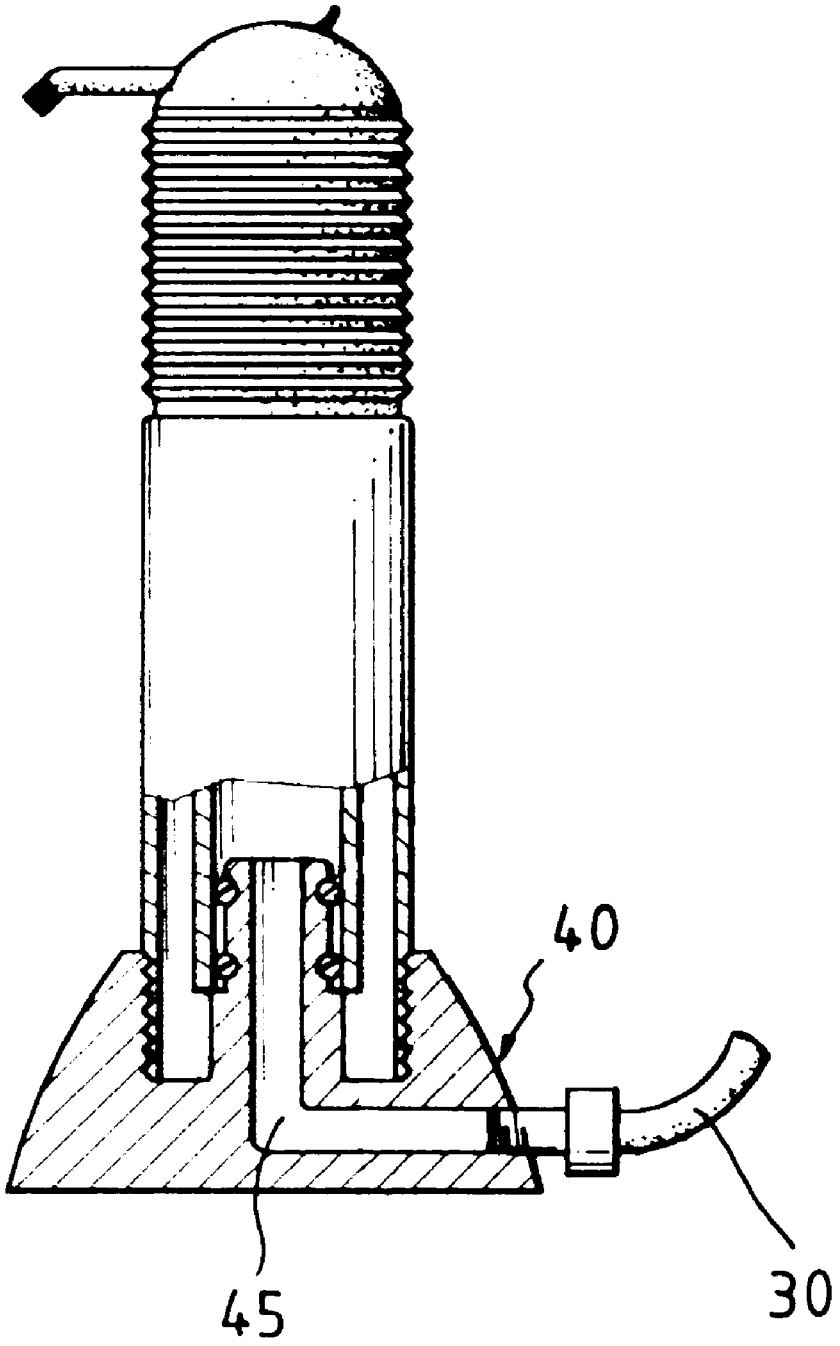
FIG. 10 is a side elevational view, partly in section, of the another embodiment of the faucet assembly in accordance with the present invention.
Figure 11:
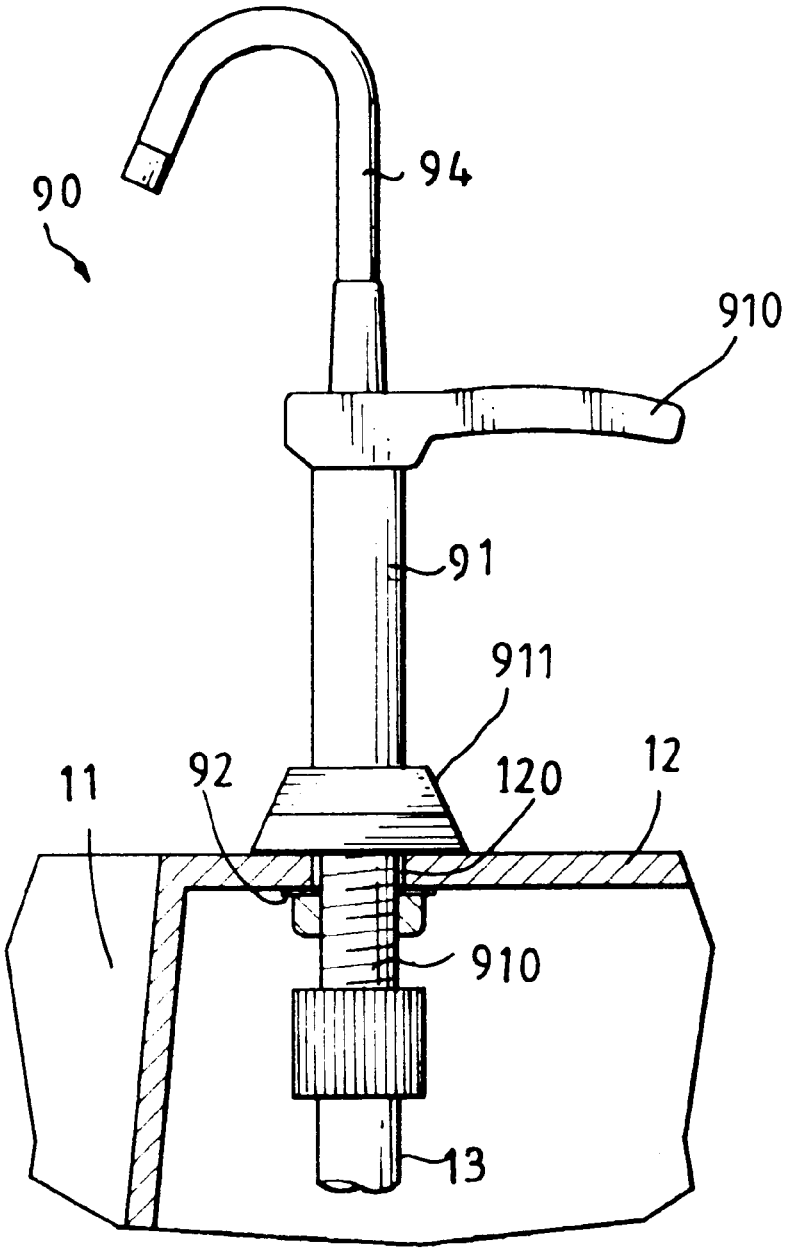
FIG. 11 PRIOR ART
FIG. 11 is a side elevational view, partly in section, of a conventional faucet assembly connected to the board of the kitchen sink.

Referring to FIG. 9, an air tube 27 is connected to the lower member 20 so as to release air maintained in the path in the faucet assembly, and a detection means 29 is connected to the faucet assembly to detect the quality of the water passing through the faucet assembly. FIG. 10 shows another embodiment of the faucet assembly wherein the base member 40 is put on a desk and has a passage 45 defined therethrough which communicates with the water pipe 30 so that there will be not necessary to drill a hole 120 through the board 12 of the kitchen sink 11 as shown in FIG. 3.

Referring to FIG. 2 again, when installing the lower member 20, a cap member 26 may securely mounted to the insertion 23 in advance and a cable 260 extends from the cap member 26 so that the lower member 20 is easily positioned by pulling the cable 260 upwardly.

It is to be understood that the above description and drawings are only used for illustrating some embodiments of the present invention, not intended to limit the scope thereof. Any variation and derivation from the above description and drawings should be included in the scope of the present invention.

What is claimed is:

1. A faucet assembly comprising:

a lower member adapted to connect to the water pipe and having an insertion extending from the top thereof, said insertion having a passage adapted to communicate with the water pipe;

a body having a top with a connecting tube extending therefrom and an inner tube extending from the underside of said top, a hole defined through said top to communicate said connecting tube and said inner tube into which said insertion is received, a skirt portion extending from the periphery of said top, said connecting tube having a ridge extending radially outward therefrom, a valve member biasedly received in said inner tube and normally closing said hole;

an outlet member having a section thereof movably inserted into said connecting tube and communicating with said connecting tube, said section of said outlet member contacting said valve member, a flange extending radially from said outlet member and a top cap mounted thereto, said flange having a slot defined therethrough and said top cap having an aperture defined therethrough, a spring urged between said flange and said top of said body, and a release mechanism having a rod which has an end plate on the first end and a hook formed on the second end thereof, said end plate movably engaged with said aperture and having a bar extending therefrom, said rod extending through said aperture and said slot, said hook disengagably engaged with said ridge.

2. The faucet assembly as claimed in claim 1, wherein said connecting tube having an annular flange extending radially inward from the inside thereof, said valve member having a disk and a valve rod extending from said disk, said valve rod having a collar member fixedly mounted thereto and a spring biased between said annular flange and said collar member, said valve rod contacting said section of said outlet member.

3. The faucet assembly as claimed in claim 1 further comprising a filter member received in said inner tube.

4. The faucet assembly as claimed in claim 1 further comprising a magnet received between said skirt portion and said inner tube.

5. The faucet assembly as claimed in claim 1 further comprising an outer tube mounted between said flange of said outlet member and said top of said body.

6. The faucet assembly as claimed in claim 1 further comprising a base member which has an inner threaded portion, said skirt portion having an outer threaded portion so as to engage with said inner threaded portion.

* * * * *